United States Patent [19]

Ventura

[11] 4,407,313

[45] Oct. 4, 1983

[54] COMBINED COIN SAVER, COUNTER AND WRAPPER

[76] Inventor: Gerard V. Ventura, 131 Richmond Ave., West Haven, Conn. 06516

[21] Appl. No.: 236,451

[22] Filed: Feb. 20, 1981

[51] Int. Cl.[3] ..... G07D 9/06

[52] U.S. Cl. ..... 133/8 A; 53/212

[58] Field of Search ..... 133/1 A, 8 A, 1 R, 8 R, 133/8 D, 8 B; 53/254, 212, 213

[56] References Cited

U.S. PATENT DOCUMENTS

| | | | |
|---|---|---|---|
| 1,085,673 | 2/1914 | Doldt | 53/254 |
| 2,549,590 | 4/1951 | Fortier | 53/213 |
| 2,678,525 | 5/1954 | Sheldon, Jr. | 53/213 |
| 3,710,544 | 1/1973 | Lamming | 133/1 R |
| 3,783,586 | 1/1974 | Dorman | 53/213 |

FOREIGN PATENT DOCUMENTS

| | | | |
|---|---|---|---|
| 632030 | 12/1961 | Canada | 133/8 R |
| 1532559 | 6/1968 | France | 133/1 R |
| 313372 | 6/1929 | United Kingdom | 53/213 |

*Primary Examiner*—Stanley H. Tollberg
*Attorney, Agent, or Firm*—Harry J. Gwinnell

[57] ABSTRACT

A combined coin counter and saver is diclosed which also provides for improved ease in coin wrapping. A base section is provided with a coin support of sufficient diameter to support a stack of coins in column fashion while allowing a coin wrapper to freely slide over the coin support. The coin support and base section also have connected thereto, an elongated arm substantially parallel to the column of coins having an upper portion which intrudes into the diameter of the column of coins and is a distance from the top of the coin support measuring an exact count column of coins. For example, in the case of pennies, the distance from the top of the support to the upper portion of the elongated arm would represent a distance equal to an exact count of 50 pennies. In operation, the coin wrapper is slid over the coin support and filled with coins to a height equal to the upper portion of the elongated arm. The column of coins contained in the wrapper is then tilted away from the elongated arm and the wrapper slid upwards such that roughly equal amounts of wrapper extend on either side of the column of coins. The upper portion of the wrapper is then folded over the coins, the coin saver inverted and removed from the wrapper and the remaining portion of the wrapper is then folded over the coins.

3 Claims, 3 Drawing Figures

COMBINED COIN SAVER, COUNTER AND WRAPPER

TECHNICAL FIELD

The field of art to which this invention pertains is containers and specifically containers and holders for coins.

BACKGROUND ART

While there have been many attempts at designing contianers for holding and counting coins, the end result with all such containers is still the manual wrapping of coins. The most popular containers are those such as the transparent semicircular type with graduated markings to indicate coin count. And while these are quite adequate for saving coins, they still present the problem of fumbling with coins when the coins must be removed and transported, for example in coin wrapping. Although this is a relatively minor problem with a limited number of coins, with a large volume of coins such a process can be highly labor intensive. Accordingly, what is needed in this area is a coin saver which will not only provide a convenient and accurate way of saving and counting coins, but will provide assistance in the more tedious task of coin wrapping.

DISCLOSURE OF INVENTION

The present invention is directed to a simple coin saver and counter which also facilitates coin wrapping by lessening individual coin handling. The coin saver according to the present invention comprises a coin support, optionally supported on a base section, and connected to an elongated arm extending substantially parallel to the coin support and area occupied or to be occupied by the column of coins supported. The elongated arm has an upper portion which extends into the area occupied or to be occupied by the column of coins and is separated a distance from the top of the support equal to an exact, predetermined count of coins. The diameter of the coin support is sufficient to support a stack of coins in column fashion, yet small enough so that a coin wrapper may easily slide onto and off of the coin support. The coin support is also of sufficient height above the base section and lower section of the elongated arm and of such shape, that the coin wrapper may slide over the coin support and extend the full distance from the base and lower section of the elongated arm to the top of the elongated arm portion.

Another aspect of the present invention is a method of saving, wrapping and counting coins whereby a coin wrapper is slipped over the coin support above described, and coins are added to the coin wrapper, which coins lie flat on the coin support in column fashion until they fill the coin wrapper to a height reaching the elongated arm. The wrapper containing the supported coins is then tilted away from the elongated arm in such a manner that the coin wrapper may be slid vertically above the column of coins to a height roughly equal to the amount of wrapper extending below the column of coins on the coin support. The coin wrapper is then folded down on top of the column of coins followed by inverting the coins saver and removing the column of coins with the wrapped portion in the inverted position. The wrapping of the coins is then completed by wrapping the remaining unwrapped end of the coin wrapper onto the column of coins.

The foregoing, and other features and advantages of the present invention, will become more apparent from the following description and accompanying drawing.

BEST MODE FOR CARRYING OUT THE INVENTION

Figure 1C:
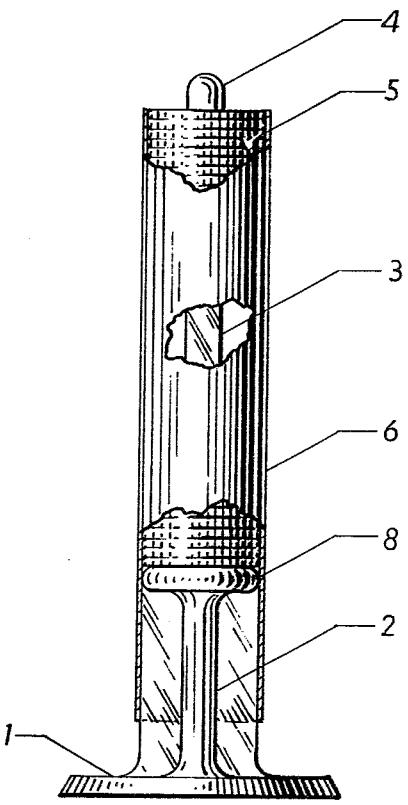
FIGS. 1*a*, 1*b*, and 1*c* show front, top and side views respectively, of a coin saver, counter and wrapper according to the present invention.
Figure 1B:
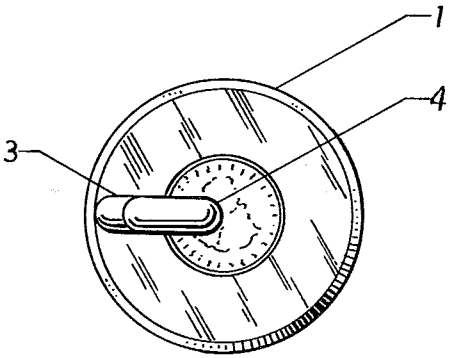
Figure 1A:
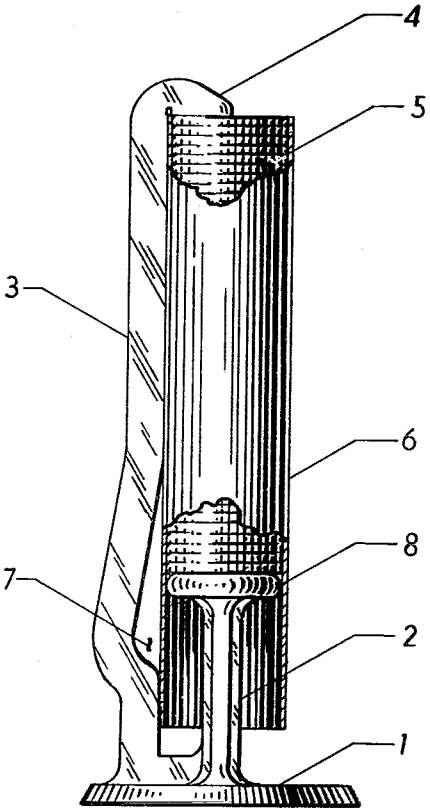

As shown in FIG. 1, 1 represents the base section, 2 represents the coin support, 3 represents the elongated arm, 4 represents the top portion of the elongated arm, 5 represents the column of coins, and 6 represents the coin wrapper. While the base section 1 is preferably included in the coin saver design so that the coins may be added a few at a time and the article may be used as a coin saver in a standing, upright position, it will be understood by those skilled in this art that the base section can be eliminated and the coin saver and wrapper simply used in its coin counter and wrapper mode. Similarly, while the elongated arm 3 is shown in FIG. 1*a* as touching the coin wrapper, it will also be understood by those skilled in the art that this would not be a necessary ingredient of the coin saver and the arm may extend equally as well away from the column of coins as long as the top section 4 intrudes into the space occupied by the column of coins.

The base section 1, if included, may be circular, rectangular, etc. as long as it is of sufficient size to support the coin saver and the column of coins securely. Also, the space 7 where the elongated arm is removed angularly from the support section, while not necessary, provides for easier insertion and removal of the coin wrapper. As can be seen from the drawing, such angular portion of the elongated arm preferably represents one-quarter to one-half of the height of the coin wrapper unfilled.

The coin saver, counter and wrapper is preferably made of a conventional commercial acrylic or other plastic material, but can also be made of wood, metal, etc. Similarly, if made of plastic, it is preferably made as one unitary piece, for example by injection molding, for cost saving purposes. However, it would be obvious to one skilled in this art to make the coin saver in a plurality of pieces and adhesively bond or otherwise physically attach the pieces. For example, the elongated arm 3 and upper portion 4 could be separately made and attached to either a combined base-coin support piece or separate base and coin support pieces which could similarly be attached to one another.

The distance between the top 8 of coin support 2 and the bottom of the upper portion 4 of the elongated arm 3 should be such as to represent a definite count of coins. For example, if the coin saver were designed for pennies, the distance should represent the height of a column of 50 pennies. Similarly, the distance could be made to contain a column of $5.00 worth of dimes, $10.00 worth of quarters, etc. or even foreign coins. The arm section 3 and base section 1 could also be made so as to include various commercial insignia, such as bank logos, etc.

As seen from FIG. 1*b*, the upper portion 4 of elongated arm 3 should intrude into the diameter of the coin support a sufficient distance such that when the coins are slid into the wrapper, a definite count can be easily measured by attaining the height of the upper portion of the elongated arm. However, the arm should not intrude into this area to such an extent as to impede or prevent the removal of the column of coins in the wrapper, once this height has been attained. As can be seen from FIG. 1*b*, an intrusion of approximately one-half the diameter of the coins being saved should be sufficient. Similarly, for stability purposes, as seen in FIG. 1*c*, the elongated arm 3 is preferably centrally located in a vertical plane substantially the same as the vertical plane of the coin support 2, so that the column when partially filled, remains vertically stable.

While the coin support can have a variety of shapes, for example, it can represent a column itself coextensive with the column of coins, the embodiment shown in FIG. 1*a* is preferred where the actual supporting plate 8 is coextensive with the coins, while an elongated neck section of coin support 2 is narrower permitting free angulation of the coin wrapper containing the column of coins. Similarly, that area 7 of the elongated arm 3 is preferably of such curved angulation so as to allow for easy insertion and removal of the wrapper along its length.

In operation, the coin wrapper 6 is inserted over coin support 2, sliding down area 7 of elongated arm 3. Once it has been inserted to a point below the upper portion 4 of elongated arm 3, the filling of the wrapper with coins may begin. The coins may be inserted a few at a time such that the article acts as a bank or a pile of coins may be inserted all at one time until the top of the elongated arm 3 is reached. In this latter case, the article serves primarily as a coin wrapper. In either case, once the upper portion 4 of elongated arm 3 is reached, the wrapper containing the coins is slid out as it was slid in.

The removal process is preferably accomplished by tilting the column of coins 5 in wrapper 6 to a point where the upper portion 4 of arm 3 is cleared. At that point, although the coins are still supported by coin support 2, the wrapper 6 may be freely slid upwards above the column of coins, preferably to a height above the column of coins equal to one-half the unfilled wrapper. At this point, the upper portion of the wrapper may be folded down onto the column of coins and the entire article inverted and the remainder of the wrapper freed from coin support 2. The lower portion of the wrapper is then wrapped down on the coins and the entire process is accomplished without any coin handling at all during wrapping.

Accordingly, it can be seen that what has been invented is a simple, convenient time-saving device which solves a tiresome, tedious coin wrapping task with relative ease.

Although this invention has been shown and described with respect to detailed embodiments thereof, it will be understood by those skilled in the art that various changes in form and detail thereof may be made without departing from the spirit and scope of the claimed invention.

I claim:

1. A combined coin saver, counter and wrapper comprising a base section having connected thereto a coin support and elongated arm having an upper portion, the base section being of sufficient size to support the coin support and elongated arm in vertical fashion on a horizontal surface, the coin support being of sufficient length extending above the base section and of sufficient diameter to allow a coin wrapper to slide freely on and off the coin support and having an enlarged top relative to its lower portion to support a stack of coins in column fashion, the elongated arm extending above the base section substantially perpendicular to the coin support and column of coins, and the upper portion of the elongated arm extending into the area to be occupied by the column of coins and diameter of the coin support at a height above the coin support so as to represent an exact count of column of coins inserted in a coin wrapper while it is around the coin support.

2. The article of claim 1 wherein the lower portion of the elongated arm is angularly displaced from the column of coins so as to allow the coin wrapper to extend into an area at the lower portion of the elongated arm for easy insertion and removal.

3. A method of saving, counting and wrapping coins comprising inserting a coin wrapper around a coin support mounted on a base section having an elongated arm substantially perpendicular to the coin support and coin wrapper, said elongated arm also having an upper portion extending a distance from the top of the coin support representing an exact count of a column of coins, filling the coin wrapper thus mounted on the coin support with coins until the column reaches a height equal to the upper portion of the elongated arm, partially removing the coin wrapper containing the column of coins so as to clear the upper portion of the elongated arm, sliding the wrapper upwards while the column of coins is still supported on the coin support a distance so that approximately equal amounts of wrapper extend above and below the column of coins, wrapping the upper portion of the coin wrapper onto the column of coins while the column of coins is still supported on the coin support, inverting the thus partially wrapped column of coins and coin saver, counter and wrapper so that the wrapper containing the column of coins may be removed entirely from the coin support without coins leaving the coin wrapper, and completing the wrapping of the exact count of column of coins by completely removing the inverted coin support from the wrapper and wrapping the remaining unwrapped portion of the coin wrapper.

* * * * *